US005363130A

United States Patent [19]

Cowger et al.

[11] Patent Number: 5,363,130

[45] Date of Patent: Nov. 8, 1994

[54] METHOD OF VALVING AND ORIENTATION SENSITIVE VALVE INCLUDING A LIQUID FOR CONTROLLING FLOW OF GAS INTO A CONTAINER

[75] Inventors: Bruce Cowger; John M. Altendorf; David J. Halko; Marc A. Baldwin, all of Corvallis, Oreg.

[73] Assignee: Hewlett-Packard Company, Palo Alto, Calif.

[21] Appl. No.: 752,107

[22] Filed: Aug. 29, 1991

[51] Int. Cl.[5] ..... B41J 2/20

[52] U.S. Cl. ..... 347/92; 137/43; 137/251.1

[58] Field of Search ..... 346/140 R, 1.1; 137/38, 137/43, 251.1

[56] References Cited

U.S. PATENT DOCUMENTS

| | | | |
|---|---|---|---|
| 3,481,205 | 12/1969 | Schmidlin | 137/251.1 |
| 4,190,426 | 2/1980 | Ruschke | 137/854 |
| 4,368,478 | 1/1983 | Koto | 346/140 |
| 4,571,599 | 2/1986 | Rezanka | 346/140 R |
| 4,620,202 | 10/1986 | Koto et al. | 346/140 |
| 4,677,447 | 6/1987 | Nielsen | 346/140 R |
| 4,689,641 | 8/1987 | Scardovi et al. | 346/140 |
| 4,791,438 | 12/1988 | Hanson et al. | 346/140 R |
| 4,920,362 | 4/1990 | Cowger | 346/140 R |
| 5,010,354 | 4/1991 | Cowger et al. . | |
| 5,039,999 | 8/1991 | Winslow et al. | 346/140 R |
| 5,040,002 | 8/1991 | Pollacek et al. | 346/140 R |

FOREIGN PATENT DOCUMENTS

| | | | |
|---|---|---|---|
| 0178879 | 4/1986 | European Pat. Off. . | |
| 0425254 | 5/1991 | European Pat. Off. . | |
| 0509686 | 10/1992 | European Pat. Off. . | |
| 56-92072 | 7/1981 | Japan | 346/140 R |
| 59-232872 | 12/1984 | Japan | 346/140 R |
| 0056868 | 2/1969 | Poland | 137/251.1 |
| PCT/US83/-00475 | 10/1983 | WIPO . | |

OTHER PUBLICATIONS

*Webster's Ninth New Collegiate Dictionary,* p. 508, 1990.

*Primary Examiner*—Benjamin R. Fuller
*Assistant Examiner*—David Yockey

[57] ABSTRACT

The valve is operable with a bubble generator that provides a restricted flow of air bubbles into a reservoir of an ink-jet pen to relieve excessive back pressure in the pen. The valve includes housed operating liquid that closes the valve in the event that the pen is tipped out of an upright orientation. A hydrophobic air-porous vent is provided for permitting passage of air bubbles through the valve into the reservoir while prohibiting the flow of the operating liquid through the vent.

18 Claims, 4 Drawing Sheets

METHOD OF VALVING AND ORIENTATION SENSITIVE VALVE INCLUDING A LIQUID FOR CONTROLLING FLOW OF GAS INTO A CONTAINER

TECHNICAL FIELD

This invention pertains to a valve used as part of an ink supply system for an ink-jet pen.

BACKGROUND INFORMATION

Ink-jet printing generally involves the controlled delivery of ink drops from an ink-jet pen reservoir to a printing surface. One type of ink-jet printing, known as drop-on-demand printing, employs a pen that includes a print head and ink reservoir. The print head is responsive to control signals for ejecting drops of ink from the ink reservoir.

Drop-on-demand type print heads typically use one of two mechanisms for ejecting drops: thermal bubble or piezoelectric pressure wave. A thermal bubble type print head includes a thin-film resistor that is heated to vaporize a small portion of the ink. The rapid expansion of the ink vapor forces a small amount of ink through a print head orifice.

Piezoelectric pressure wave type print heads use a piezoelectric element that is responsive to a control signal for abruptly compressing a volume of ink in the print head to produce a pressure wave that forces the ink drops through the orifice.

Although conventional drop-on-demand print heads are effective for ejecting or "pumping" ink drops from a pen reservoir, they do not include any mechanism for preventing ink from permeating through the print head when the print head is inactive. Accordingly, drop-on-demand techniques require the fluid in the ink reservoir to be stored in a manner that provides a slight back pressure at the print head to prevent ink leakage from the pen whenever the print head is inactive. As used herein, the term "back pressure" means the partial vacuum within the pen reservoir that resists the flow of ink through the print head. Back pressure is considered in the positive sense so that an increase in back pressure represents an increase in the partial vacuum. Accordingly, back pressure is measured in positive terms, such as inches of water column height.

The back pressure at the print head must be at all times strong enough for preventing ink leakage. The back pressure, however, must not be so strong that the print head is unable to overcome the back pressure to eject ink drops. Moreover, the ink-jet pen must be designed to operate despite environmental changes that cause fluctuations in the back pressure.

A severe environmental change that affects reservoir back pressure occurs during air transport of an ink-jet pen. In this instance, ambient air pressure decreases as the aircraft gains altitude and is depressurized. As ambient air pressure decreases, a correspondingly greater amount of back pressure is needed to keep ink from leaking through the print head. Accordingly, the level of back pressure within the pen must be regulated during times of ambient pressure drop.

The back pressure within an ink-jet pen reservoir is also subjected to what may be termed "operational effects." One significant operational effect occurs as the print head is activated to eject ink drops. The consequent depletion of ink volume from the reservoir increases (creates greater vacuum) the reservoir back pressure. Without regulation of this back pressure increase, the ink-jet pen will eventually fail because the print head will be unable to overcome the increased back pressure to eject ink drops. Such failure wastes ink whenever the failure occurs before all of the useable ink within the reservoir has been ejected.

Past efforts to regulate reservoir back pressure in response to environmental changes and operational effects have included mechanisms that may be collectively referred to as accumulators. Generally, an accumulator comprises a movable mechanism that is mounted to the pen to define an accumulator volume that is in fluid communication with the ink-jet pen reservoir volume. The accumulator moves between a minimum volume position and a maximum volume position in response to changes in the level of the back pressure within the reservoir. Accumulator movement changes the overall volume of the reservoir to regulate back pressure level changes so that the back pressure remains within an operating range that is suitable for preventing ink leakage while permitting the print head to continue ejecting ink drops.

For example, as the difference between ambient pressure and the back pressure within the pen decreases as a result of ambient air pressure drop, the accumulator moves to increase the reservoir volume, thereby to increase the back pressure to a level (within the operating range mentioned above) that prevents ink leakage. Put another way, the increased volume attributable to accumulator movement lessens a reduction in the difference between ambient air pressure and back pressure that would otherwise occur if the reservoir were constrained to a fixed volume as ambient air pressure decreased.

Accumulators also move to decrease the reservoir volume whenever environmental changes or operational effects (for example, ink depletion occurring during operation of the pen) cause an increase in the back pressure. The decreased volume attributable to accumulator movement reduces the back pressure to a level within the operating range, thereby permitting the print head to continue ejecting ink.

Accumulators are usually equipped with internal or external resilient mechanisms that continuously urge the accumulators toward a position for increasing the volume of the reservoir. The effect of the resilient mechanisms is to retain a sufficient minimum back pressure within the reservoir (to prevent ink leakage) even as the accumulator moves to increase or decrease the reservoir volume.

Accumulators have been used in conjunction with devices known as bubble generators. Bubble generators permit ambient air bubbles to enter the ink reservoir once the accumulator has moved to its minimum volume position (that is, once the accumulator is unable to further reduce the back pressure within the reservoir) and the back pressure continues to rise as the print head continues to eject ink from the reservoir. The air bubbles delivered by the bubble generator increase the fluid volume in the reservoir thereby to keep the reservoir back pressure from increasing to a level that would cause failure of the print head.

Bubble generators generally comprise a small-diameter orifice that provides fluid communication between the pen reservoir and ambient air. Because of the reservoir back pressure maintained by the accumulator, ink does not leak through the bubble generator orifice.

Moreover, because the reservoir ink normally covers the bubble generator orifice, ambient air is unable to enter the reservoir until the back pressure increases to a level great enough for drawing air bubbles into the reservoir ink.

One problem with the use of bubble generators arises whenever the pen is moved (for example, inverted) to a position where the reservoir ink no longer covers the orifice to restrict the inflow of ambient air. The consequent unrestricted flow of ambient air into the reservoir will eliminate the back pressure that is required for proper operation of the print head.

SUMMARY OF THE INVENTION

This invention is directed to a valve that is useful with a bubble generator for regulating back pressure in an ink-jet pen and that reliably prevents unintended elimination of back pressure in the pen whenever the pen is moved to a position where reservoir ink no longer covers the bubble generator orifice.

DETAILED DESCRIPTION

Figure 1:
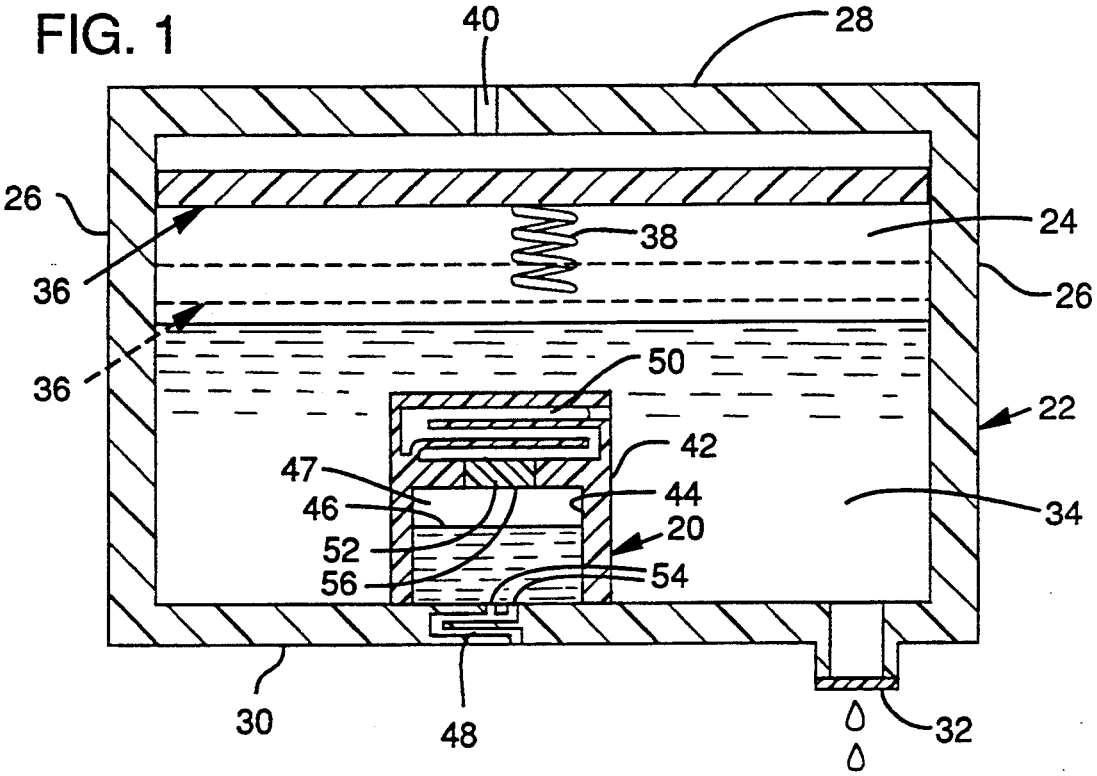
FIG. 1 is a schematic, cross-sectional diagram of a valve formed in accordance with the present invention.

Referring first to the schematic diagram of FIG. 1, a preferred valve 20 of the present invention is attached to a conventional ink-jet pen 22. The pen 22 is formed of plastic, such as polysulfone, and includes an ink-containing reservoir 24 that is defined by side walls 26, a top 28, and a bottom 30. A print head 32 is mounted to the pen 22 and is responsive to control signals for ejecting drops of ink from the reservoir 24. After the reservoir 24 is filled with ink 34, a back pressure is established in the reservoir by, for example, removing a small amount of air or ink from the otherwise sealed reservoir 24.

In a preferred embodiment, the valve 20 is used in conjunction with an accumulator, such as schematically illustrated at 36 in FIG. 1. The accumulator 36 is normally urged toward a maximum volume position (solid lines in FIG. 1) by a resilient mechanism, such as represented by the spring 38. Part of the accumulator 36 is in fluid communication with ambient air through a port 40 formed in the top 28 of the pen 22.

Whenever the difference between ambient air pressure and the reservoir back pressure changes as a result of the environmental or operational effects mentioned earlier, the accumulator 36 moves to change the reservoir volume, thereby to regulate the back pressure and keep the back pressure level within an operating range. For example, the accumulator 36 moves toward a minimum volume position (the minimum volume position of the accumulator represented by dashed lines in FIG. 1) for decreasing the reservoir volume as ink 34 is depleted during operation of the print head 32. The ink depletion causes an increase in the reservoir back pressure, and the reservoir volume decrease limits the amount of back pressure increase.

In some instances, a significant quantity of ink 34 may remain in the reservoir 24 after the accumulator 36 has moved to the minimum volume position. Consequently, as the print head continues to operate, the reservoir back pressure continues to increase toward a level that would cause failure of the print head. A bubble generator mechanism for permitting restricted entry of air bubbles into the reservoir 24 is provided for regulating (i.e., lowering) the back pressure in such instances. That bubble generator mechanism operates in conjunction with the valve 20 of the present invention and is described more fully below.

It is contemplated that the valve 20 of the present invention may be used with any type of accumulator mechanism. The accumulator, however, forms no part of this invention.

The valve 20 of the present invention (FIG. 1) includes a housing 42 that is attached to the bottom 30 of the pen 22. The housing 42 defines an internal chamber 44 that carries a valve-operating liquid 46, such as water. An elongated inlet passage 48 extends through the bottom 30 of the pen 22 and provides fluid communication between the valve chamber 44 and ambient air. An elongated outlet passage 50 is defined in the housing 42 above the chamber for providing fluid communication between the valve chamber 44 and the ink reservoir 24. The normal back pressure in the reservoir keeps the ink 34 from flowing entirely through the passage 50.

A hydrophobic, porous vent 52 is mounted to the housing 42 at a location that separates the chamber 44 from the outlet passage 50. The level of the operating liquid 46 is beneath the inner face 56 of the vent 52 by an amount that defines an air space 47 between the vent 52 and the liquid 46.

As the pen 22 is operated in the upright position represented in FIG. 1, the print head 32 continuously depletes the ink 34 from the reservoir 24. This depletion of ink volume increases the back pressure within the reservoir 24, the back pressure increase being initially regulated by movement of the accumulator 36 toward the minimum volume position (dashed lines in FIG. 1) to reduce the reservoir volume and, therefore, prevent the back pressure from exceeding a level that could not be overcome by the activated print head 32.

Once the accumulator 36 has moved to the minimum volume position, the back pressure in the reservoir 24 will continue to rise as the print head 32 continues to eject ink from the reservoir 24. In accordance with the present invention, the continued rise of the reservoir back pressure is regulated (i.e., reduced) by the passage of ambient air bubbles into the reservoir 24 through the valve 20. In this regard, the back pressure within the upright pen reservoir 24 is continuously communicated through the outlet passage 50 and porous vent 52 to the chamber 44. Whenever the back pressure exceeds a threshold or "bubble pressure" (described below), an air bubble will be drawn into the operating liquid 46 through the inlet passage 48 and move by buoyant force to join the air space 47 above the operating liquid 46. The resulting increase in the air volume in the chamber 44 is transmitted through the air-porous vent 52 and outlet passage 50 into the reservoir 24, thereby increasing the reservoir fluid volume to reduce the back pressure level.

The inner terminus of the inlet passage 48 is in fluid communication with two small-diameter orifices, referred to as bubble generators 54, that are sized so that air bubbles will be drawn through a bubble generator 54 and into the chamber 44 whenever the back pressure exceeds the bubble pressure.

Whenever the pen 22 is tipped out of the upright position depicted in FIG. 1, the operating liquid 46 will flow to cover the inner face 56 of the hydrophobic, porous vent 52 before a bubble generator 54 is uncovered by the liquid 46, thereby preventing any unrestricted flow of ambient air into the reservoir through the inlet passage 48 and outlet passage 50, which flow would otherwise occur if a direct air path were developed between a bubble generator 54 and the vent 52:. The pore size and hydrophobic characteristics of the vent 52 prevent the operating liquid 46 from permeating through the vent 52 and into the reservoir ink 34.

The outlet passage 50 is designed so that the reservoir ink 34 will not contact the hydrophobic vent 52, which contact may have a deleterious effect on the hydrophobic and air-porous characteristics of the vent 52. In this regard, the outlet passage 50 is configured so that the reservoir ink 34 will not reach the vent 52, irrespective of a substantial decrease in the volume of air space 47, such as may occur when the pen 22 is placed in a low-temperature environment.

As the pen is tipped so that the inner face 56 of the vent 52 is covered with the operating liquid 46 (FIG. 6), the air in the chamber is unable to flow out through the vent 52. If, while the pen is tipped, fluid pressure within the chamber 44 significantly increases relative to ambient as a result of a severe environmental change (such as a drop in ambient air pressure during air-transport of the pen), the trapped air in chamber 44 expands and forces the liquid 46 into the inlet passage 48. The inlet passage 48 is designed so that the liquid 46 collects in the inlet passage 48 and does not leak out of the passage 48. Moreover, as the normal operational environment is restored so that fluid pressure in the chamber decreases, the liquid 46 is drawn back into the chamber 44. The inlet passage 48 is also designed to minimize vapor diffusion loss of the liquid 46 through the passage 48.

Figure 3:
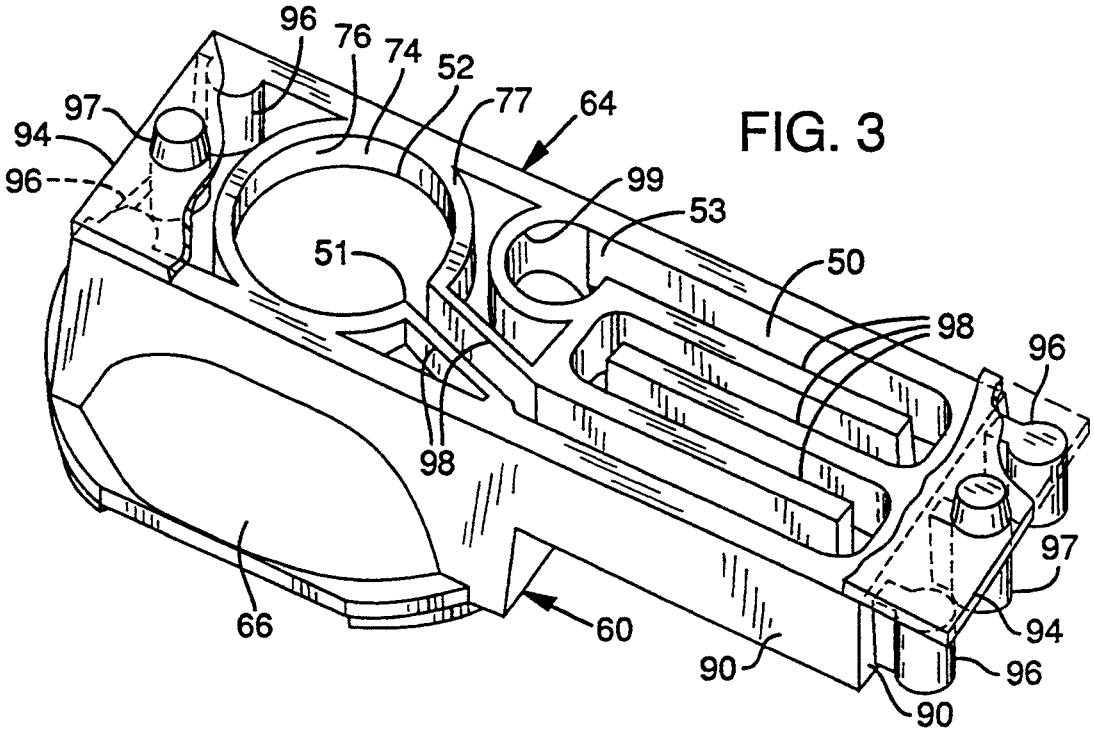
FIG. 3 is a perspective top view of the upper portion of the valve.
Figure 2:
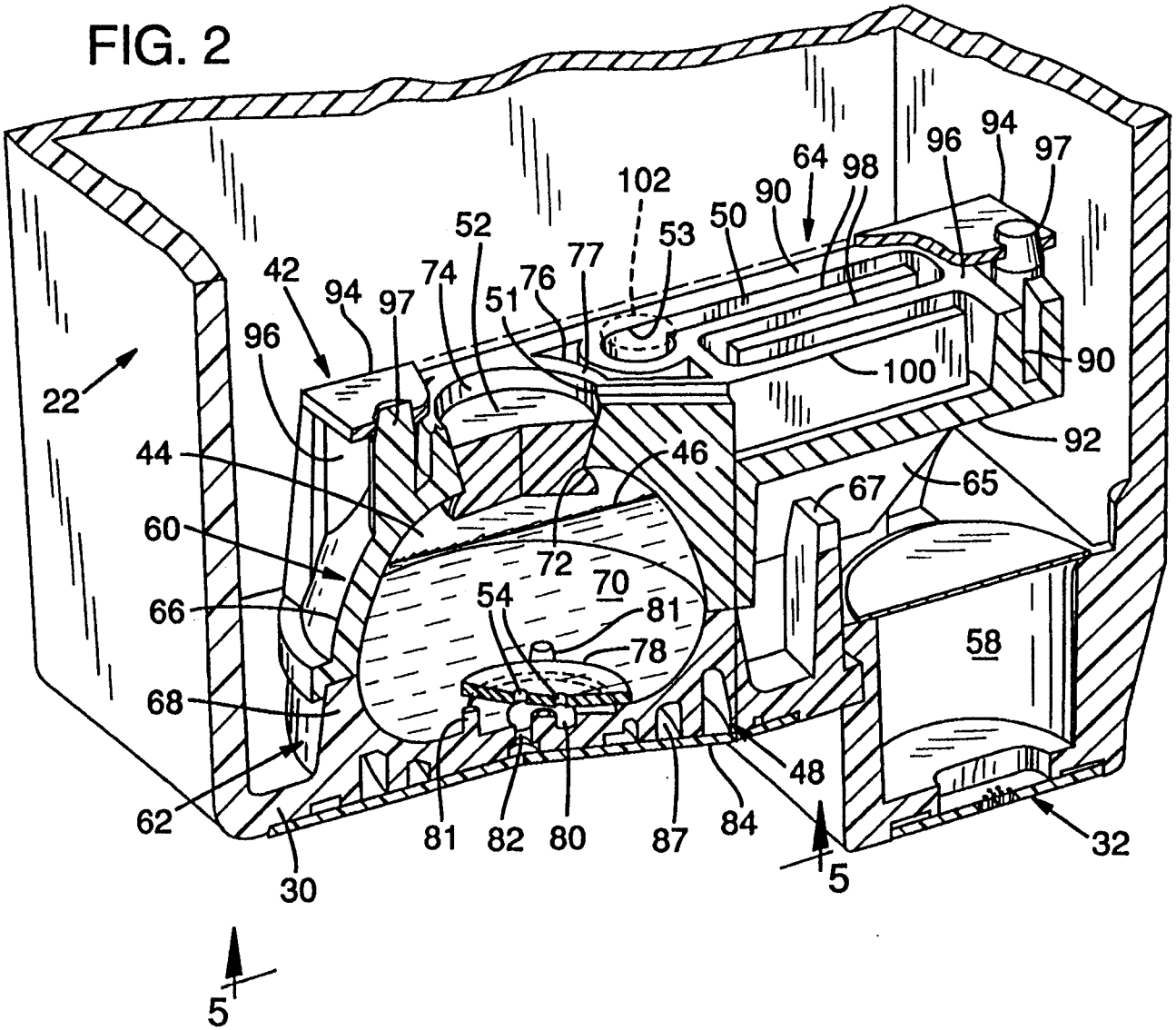
FIG. 2 is a sectional perspective view of the valve as part of an upright ink-jet pen.

Turning to the particulars of the preferred embodiment of a valve 20 of the present invention, and with particular reference to FIGS. 1–3, the valve housing 42 of the present invention is partly incorporated into the bottom 30 of a conventional ink-jet pen 22. The pen 22 includes a downwardly extending print head well 58 through which reservoir ink 34 passes to be ejected therefrom by a conventional drop-on-demand print head 32.

The valve housing 42 includes a chamber portion 60, an inlet portion 62, and an outlet portion 64. The housing 42 is preferably formed of injection-molded polysulfone. The inlet portion 62 is formed in the bottom 30 of the pen 22. The chamber portion 60 is integrally formed with the outlet portion 64 and those portions 60, 64 are thereafter attached, as by ultrasonic welding, to the inlet portion 62.

The chamber portion 60 of the housing 42 includes a generally dome-shaped top 66 that is attached to an annular rim 68 that projects upwardly (FIG. 2) from the bottom 30 of the pen 22. The inner surface 70 of the joined rim 68 and top 66 defines the valve chamber 44 that carries the operating liquid 46.

The upper region of the chamber surface 70 is dome-shaped and has an aperture 72 formed therein to provide fluid communication between the chamber 44 and the interior opening 74 of a ring 76 that projects upwardly from the top 66 of the chamber portion 60. The walls of the ring opening 74 converge slightly inwardly (i.e., downwardly in FIG. 2), and the porous hydrophobic vent 52 is press-fit into the opening 74 to separate the chamber 44 from the outlet passage 50.

The lower region of the chamber inner surface 70 includes a flat central part upon which is attached a bubble generator plate 78. The plate 78 includes two through-orifices, which serve as the bubble generators 54 mentioned earlier. The plate 78 is attached, such as by ultrasonic welding, to the chamber surface 70 so that the bubble generators 54 are in fluid communication with an annular inner terminus 80 of the inlet passage 48.

Preferably, the plate 78 is fit between three spaced-apart positioning posts 81 formed in the pen bottom 30.

Figure 5:
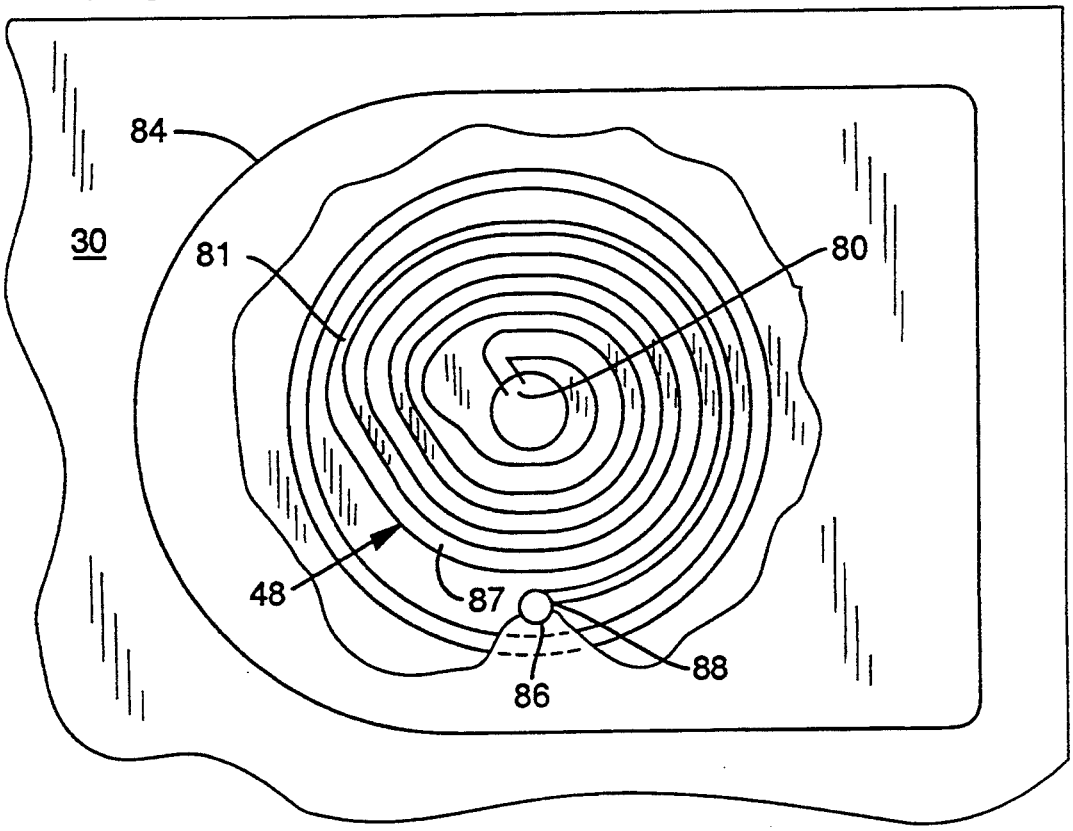
FIG. 5 is a bottom plan view of the valve.

The inner terminus 80 of the inlet passage 48 generally comprises an annular groove formed in the bottom center of the chamber surface 70 beneath the orifice plate 78. A connector portion 82 of the inlet passage 48 extends from the terminus 80 through the bottom 30 of the pen to connect the inner terminus 80 with the remaining portion of the inlet passage 48, which remaining portion comprises a helical groove 87 formed in the underside of the pen bottom 30 (FIG. 5). The helical groove 87 is completely covered by a flat bottom plate 84 that is welded to the underside of the pen bottom 30. A single opening 86 through the bottom plate 84 at the outer terminus 88 of the inlet passage groove 87 provides fluid communication between ambient air and the passage 48.

The outlet portion 64 of the valve housing 42 is integrally formed with the chamber portion 60 and includes a plurality of walls 90, 92, 98 for defining the outlet passage 50. More particularly, the outlet portion 64 has exterior side walls 90 and a bottom wall 92 that define a generally oblong-shaped volume protruding from one side of the chamber portion 60.

The protruding part of the outlet portion 64 is secured to the bottom 30 of the pen 22 by a thin support web 65 that projects downwardly from the bottom wall 92 to intersect with and attach to another thin support web 67 that projects upwardly from the pen bottom 30 near the well 58.

The top of the outlet portion 64 is covered with a thin top plate 94, which plate 94 also extends across the top of the ring 76 that is formed in the chamber top 66. As best shown in FIG. 3, each corner of the top plate 94 rests upon the upper planar surface of a generally cylindrical support 96 that is formed near each corner of the exterior side walls 90. Registration posts 97 are formed in opposing ends of the outlet portion 64 to project through holes in the top plate 94 so that the top plate 94 will remain in place during ultrasonic welding of the plate 94 to the outlet portion 64.

Figure 4:
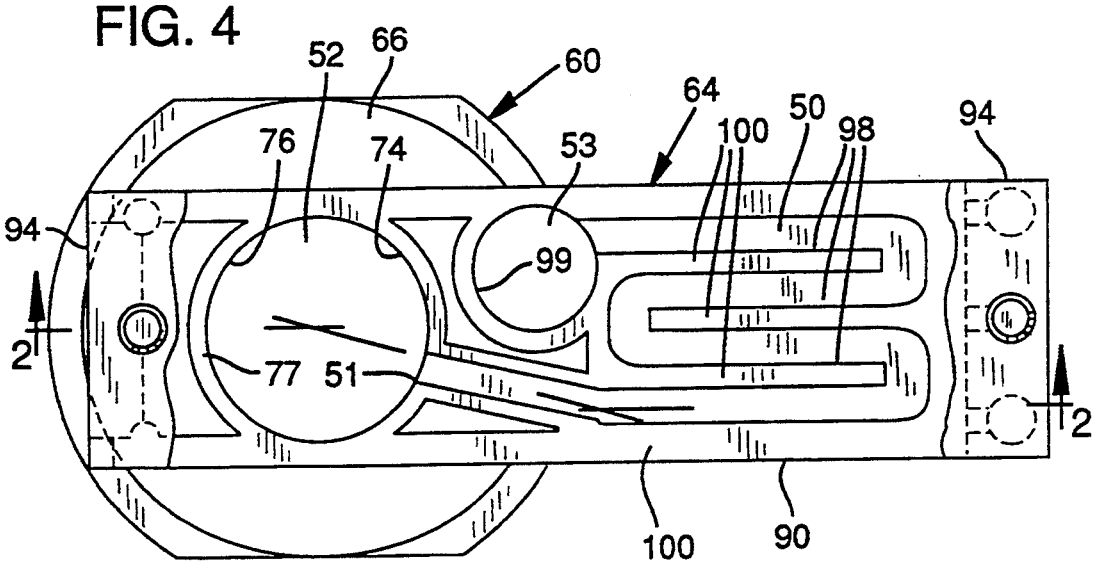
FIG. 4 is a top plan view of the valve.

As shown in FIGS. 3 and 4, a series of thin interior walls 98 are formed in the outlet portion 64 to extend between the bottom wall 92 and the top plate 94. The interior walls 98 are arranged to define between them the main portion of the outlet passage 50. More particularly, the top plate 94 is fastened to the outlet portion 64 in a manner such that the plate 94 is sealed to the upper surface 77 of the top ring 76 and to the upper surface 100 of the interior walls 98 and exterior walls 90 of the outlet portion 64, thereby to define the elongated, continuous outlet passage 50.

The inner end 51 of the outlet passage 50 opens to the cylindrical space above the vent 52 and beneath the top plate 94 within the ring opening 74. The outer end 53 of the outlet passage 50 is formed by a curved interior wall 99 that is concentric with and underlies a port 102 (FIG. 2) formed through the top plate 94. The port 102 provides fluid communication between the interior of the reservoir 24 and the outer end 53 of the outlet passage 50.

The interior walls 98 of the outlet portion 64 are arranged to define the outlet passage 50 as an elongated zig-zag shape disposed within a relatively small volume. The significance of the dimensions of the outlet passage 50 is described more fully below.

During normal operation of an upright pen, the back pressure within the reservoir 24 gradually increases as the volume of the ink 34 in the reservoir decreases. As noted earlier, this increase in back pressure may be initially regulated by an accumulator 36 that moves toward a minimum volume position for reducing the reservoir volume and back pressure. Whenever the accumulator moves to its minimum volume position, the reservoir back pressure will continue to increase as the print head 32 is operated to remove all of the ink from the pen 22.

As the back pressure within the pen reaches the above-mentioned bubble pressure, ambient air in the inlet passage 48 will be drawn through one or both of the bubble generators 54 for reducing the reservoir back pressure as described above.

The bubble pressure (that is, the level of the back pressure above which an air bubble is drawn into the chamber 44 through a bubble generator 54) can be quantified as the pressure equal to ambient pressure less the internal pressure of a single air bubble formed in the operating liquid 46 adjacent to the bubble generator 54. Put another way, in order for air to be drawn as a free bubble into the valve liquid 46, the pressure in that liquid must be sufficiently lower than the (ambient) air pressure at the bubble generator so that the pressure differential between ambient and the liquid at the bubble generator forces air into the water. In this regard, the air pressure of an air bubble surrounded by a liquid is, in accordance with Laplace's equation, higher than the pressure of the liquid by the quotient of twice the liquid surface tension and the radius of the bubble. The radius of the air bubble is directly related to the diameter of the bubble generator orifice.

In the preferred embodiment, wherein water is the operating liquid 46, a bubble generator 54 having a diameter of about 0.0095 inches will produce an air bubble in an operating liquid at about 4.5 inches (water column) of back pressure in the reservoir as measured at the print head 32. This bubble pressure is well beneath the back pressure (approximately 12.0 inches water column) that could not be overcome by (i.e., would "deprime") a conventional print head.

As each air bubble enters the chamber 44 through a bubble generator 54, a small volume of the air in the air space 47 rushes through the vent 52 and into the reservoir 24 to lower the back pressure. As the print head 32 continues to eject ink from the reservoir, the back pressure again rises until the bubble pressure is again exceeded. This periodic increase and decrease of the reservoir back pressure and consequent periodic introduction of bubbles through the bubble generator 54 defines over time a back pressure variation range having an upper limit at the bubble pressure and a lower limit at the back pressure established at the instant an air bubble volume reaches the reservoir.

It will be appreciated by one of ordinary skill in the art that this back pressure variation range can be changed by changing the diameter of the bubble generator, hence changing the size of the air volume introduced by each bubble. It has been found, however, that the preferred bubble generator diameter mentioned above provides an acceptable back pressure variation range while facilitating reliable construction of such bubble generators in a bubble generator plate of, for example, 0.005 inch-thick polysulfone.

As each air bubble lifts from the bubble generator, the liquid 46 in the chamber 44 flows quickly back toward the bubble generator 54, and the momentum of the liquid may force a small amount of that liquid into the bubble generator 54. In order to avoid the formation of a capillary bridge from the bubble generator and into the inlet passage 48 as a result of the phenomenon just mentioned, the width of the groove that defines the inner terminus 80 of the inlet passage 48 is wider than the combined diameters of the bubble generators 54. Consequently, any liquid 46 that may flow into a bubble generator orifice 54 will not engage a wettable surface near the underside of the bubble generator plate 78, the presence of which surface could establish the capillary bridge mentioned above.

It is noteworthy here that the level of the liquid 46 within the chamber 44 must be beneath the inner face 56 of the hydrophobic vent 52 when the pen is in the upright (operating) position (FIG. 2) so that any air introduced through the bubble generators 54 (hence, into the air space 47 above the liquid 46) will force out through the vent 52 a corresponding volume of air. Moreover, the minimum volume of the air space 47 required for proper operation of the bubble generators 54 is that volume displaced by the volume of a single bubble drawn through the bubble generator 54. Upon reading this description, it will be appreciated that in the event the inner face 56 of the vent 52 were covered with the liquid 46, the vent 52 will be closed to the passage of air.

The amount of operating liquid 46 present in the preferred valve chamber 44 should not be less than that required for covering the bubble generators 54 with sufficient liquid depth so that a bubble can enter the chamber 44 unaffected by the air/water interface at the top of the liquid 46. In the preferred embodiment, 0.20 inches of liquid over the bubble generators should be a sufficient depth for avoiding this problem.

As noted, the preferred operating liquid 46 is water, which, having a very high surface tension, is able to seal a relatively large-diameter bubble generator. Larger diameter bubble generators are preferred for simplifying manufacture of the bubble generator plate. Water is also preferred over other liquids, such as ink, because the water surface tension remains substantially constant irrespective of diffusion losses, and because it is unlikely to render hydrophilic the porous vent 52. Further, conventional biocides can be readily dissolved in the water operating liquid 46 for preventing growth of microorganisms, which may contaminate the vent. In the preferred embodiment, from 0.03% to 0.1% by weight of Nuosept C, available from Nuodex Incorporated, Piscataway, N.J., is used as a biocide. Other commercial water-soluble antimicrobial agents can also be used. With water as the operating liquid 46, the valve 20 may be employed with pens operating with any of a variety of ink types, but the bubble pressure characteristic of the valve will remain constant irrespective of the type of ink.

Any of a variety of materials may be used to form the porous vent 52. Preferably, the vent is formed of polytetrafluoroethylene (PTFE), in the form of a pellet or plug made of the PTFE material such as manufactured by Porex Technologies of Fairburn, Ga. It is contemplated, however, that porous PTFE material in the configuration of a thin film or membrane may be used and staked in place across the opening 74.

The flow area, thickness, and the porosity of the vent 52 is selected so that the vent 52 has a characteristic water initiation pressure (WIP). This WIP characteristic is a measure of the resistance to water permeation through the vent. Resistance to water permeation ensures that the vent will remain porous to air. Moreover, the value of the WIP is selected so that in the event the vent is covered with water (such as occurs when the pen is placed on its side, FIG. 6), and there is a coincident increase in the reservoir back pressure as may occur when a nearly empty, inverted pen is subjected to extreme cold, water in the valve 20 will not pass through the vent. If under such circumstances the WIP were too low, and water 46 passed through the vent 52, the back pressure would drop (as a result of the volume of water and air entering the reservoir 24) to a level such that the print head would likely leak when the pen is returned to the upright position.

In a preferred embodiment, a PTFE plug having 5 μm diameter average pore size, a thickness of 0.110 inches and a diameter of about 0.205 inches is suitable for use with the present valve when press fit into the opening 74 so that the maximum compression of the vent 52 is about 11%.

During operation of the bubble generators 54, air passing through the vent 52 enters the elongated passage 50. Preferably, the dimensions of the outlet passage 50 are such that any reservoir ink 34 that may drawn into the passage 50 though the outer end 53 (as may occur, for example, when air in the chamber 44 and outlet passage 50 contracts as a result of a substantial decrease in ambient temperature) will not travel completely through the passage 50 to reach to vent 52. It is desirable to avoid contact between the ink 34 and the vent 52 because such contact may contaminate the PTFE material and render it hydrophilic, which would reduce its capability to pass air from the chamber 44 to the passage 50. To this end, the volume of the outlet passage 50 between the port 102 and the vent 52 is selected so that it is greater than the maximum air volume change that will occur as a result of the maximum contraction of the air in chamber 44 and passage 50 as noted above. For example, for a valve chamber holding about 0.013 cubic inches of air, which, as a result of the ambient temperature drop contracts to about 65% of its volume at ambient temperature, an outlet passage volume of greater than about (1–0.65 * 0.013), or 0.005 cubic inches, will accommodate all ink drawn into the passage 50 (without contacting the vent 52) as a result of a 35% contraction of the air within the chamber 44 and passage 50.

The dimensions of the outlet passage 50 are such that when the air in the chamber and outlet passage 50 expands as the temperature returns to ambient, any ink that was drawn into the outlet passage 50 will flow back into the reservoir and not be stranded in the passage 50. To this end, the maximum cross-sectional dimension of the passage 50 is small enough so that the ink will form a complete meniscus across the cross section at any location in the passage. As a result, the portion of the passage 50 receiving ink is completely filled with ink. It can be appreciated that, in the absence of the complete meniscus, small amounts or beads of ink may be stranded within the passage 50 when the air in the chamber 44 and passage 50 expand and contract over several cycles. Ultimately, enough ink may accumulate in the passage 50 so that it eventually reaches, and contaminates, the vent 52. In a preferred embodiment, it is found that a complete ink meniscus will be formed within the outlet passage, provided that the maximum cross-sectional dimension of the passage does not exceed about 0.035 inches.

As noted earlier, the valve 20 of the present invention is configured so that in the event the pen is tipped out of the upright orientation, no direct air path will be created between ambient and the reservoir via the bubble generators 54 and vent 52. In this regard, the chamber 44 is shaped so that as the pen is moved from the upright toward the inverted position (FIG. 8) the operating liquid 46 will cover the inner face 56 of the vent 52 before either bubble generator 54 is uncovered by the liquid 46. As noted earlier, once the surface of the vent 52 is covered with water, air is unable to penetrate the vent, hence no direct path of air will exist between the uncovered bubble generators 54 and the vent 52. The vent is closed.

Figure 6:
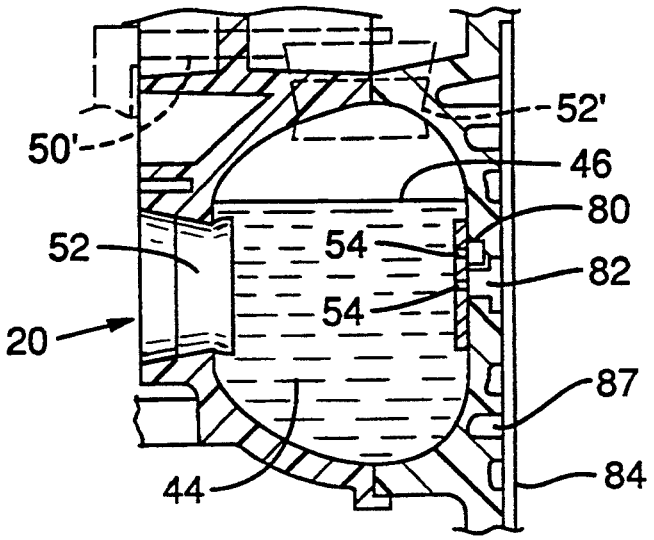
FIG. 6 is a cross-sectional view showing the valve with the pen placed on its side.
Figure 7:
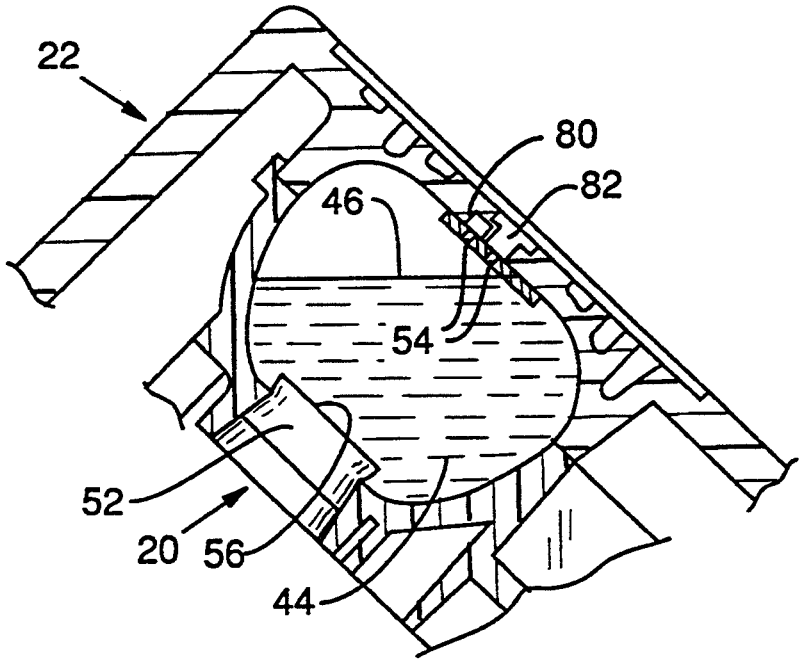
FIG. 7 is a cross sectional view showing the pen and valve being tipped from its side toward an inverted position.
Figure 8:
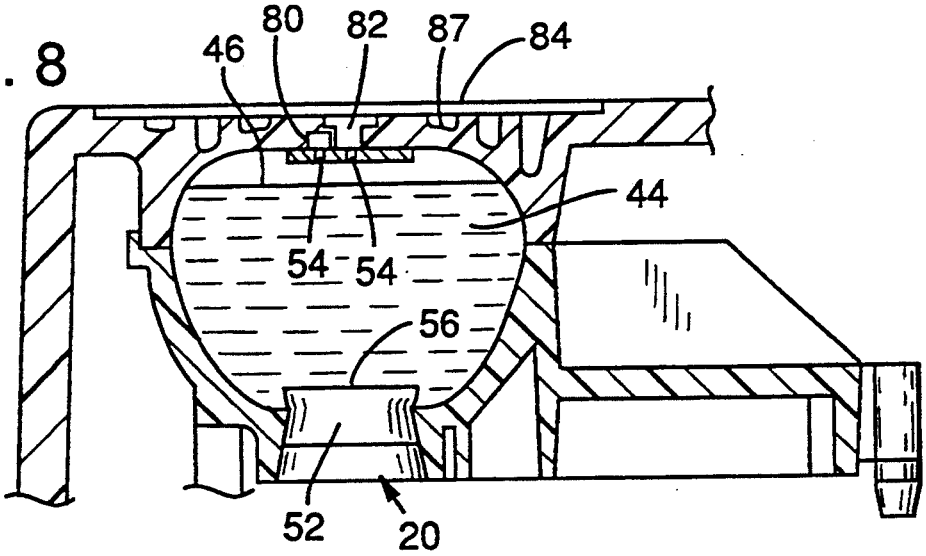
FIG. 8 is a cross sectional view showing the pen and valve in an inverted position.

More particularly, with reference to FIGS. 6–8, the cross-sectional configuration of the chamber 44 is somewhat pear-shaped, thereby to hold a sufficient volume of liquid 46 so that as the pen is moved out of the upright position and rotated onto its side as shown in FIG. 6, the bubble generators 54 will remain covered with the liquid 46 as the inner face 56 of the vent is submerged in the liquid. As the pen is moved out of the sideways orientation (FIG. 6) toward the completely inverted orientation (FIG. 8) the bubble generators 54 eventually become uncovered (FIG. 7), but only well after the vent 52 is completely closed by the liquid 46. It will be appreciated by one of ordinary skill in the art that any variety of chamber shapes may be used for ensuring that the vent 52 is covered with operating liquid 46 before the bubble generators 54 are uncovered.

With particular reference to FIG. 6, it is noted that during the time the pen is in the sideways orientation (that is, both the vent 52 and the bubble generators 54 are covered with operating fluid 46), the pen may be subjected to environmental conditions (for example, ambient temperature increase or pressure drop) that will cause expansion of the air in the chamber 44. This expansion will force the operating fluid 46 out of the chamber through the path of least resistance, namely, the inlet passage 48. In accordance with the present invention, the inlet passage is configured so that any operating liquid 46 that is forced into it as a result of the environmental effect just mentioned will be completely stored within the inlet passage 48.

In view of the foregoing, it will be appreciated that the volume defined by the inlet passage 48 is selected to be slightly greater than the maximum volume that the air within chamber 44 will expand when subjected to the greatest expected environmental effect. For example, in a preferred embodiment, it is contemplated that the air within chamber 44 may expand as much as 35 percent when the pen is subjected to an ambient pressure drop as may occur during air-transport of the pen. Accordingly, the volume of the inlet of passage 48 should be slightly greater than the volume represented by the 35 percent increase in the air volume in the chamber, about 0.005 cubic inches.

In accordance with the present invention, the volume of the inlet passage 48 is provided in a relatively compact arrangement of the passage; namely, the helical groove 87 formed in the bottom 30 of the plate (see FIG. 5). In the preferred embodiment, the cross-sectional dimension of the groove 87 varies along the length of the groove between the inner terminus 80 of the groove to a intermediate point 81 in the groove near the outer terminus 88. While a constant cross-sectional shape is possible, the preferred variable cross-sectional shape is utilized so that the groove 87 can provide a coring function necessary for insuring uniform cooling during molding of the injection-molded inlet portion 62 of the housing 42.

As the pen returns to a normal environmental condition (that is, when the air in chamber 44 contracts), all of the operating liquid 46 within the inlet passage 48 will be drawn back into the chamber 44. Put another way, practically no amount of the operating liquid 46 will be stranded within the inlet passage 48. In order to ensure that any water forced into the inlet passage 48 is withdrawn back into the chamber 44 once the air and chamber again contracts, the cross-sectional dimensions of the passage 48 are configured small enough so that the water will form a complete meniscus across the cross-section at any location in the passage. In the preferred embodiment, it is found that a complete water meniscus is formed within the inlet passage 48 as long as the minimum cross-sectional dimension of the passage does not exceed about 0.035 inches and the maximum cross-sectional dimension of the passage does not exceed about 0.090 in.

In a preferred embodiment, the volume of the inlet passage 48 for storing chamber fluid 46 as just described is located between the intermediate point 81 and the inner terminus 80 of the inlet passage 48. Contiguous with this first section of the inlet passage 48 there is, between intermediate point 81 and outer terminus 88, a second passage section having a relatively small cross-sectional area. This second section serves as a diffusion barrier to limit the loss of operating liquid mass by diffusion through the inlet passage 48. The rate of the water mass diffusion through a conduit can be derived from Fick's first law of diffusion and expressed as:

$q = A/L$ * 2.25 at 30° C., 0% ambient relative humidity.

Where "q", is water mass diffusion in grams per day, "A" is the area of the conduit and "L" is the length of the conduit. In view of the foregoing, a preferred embodiment of the diffusion barrier section of the inlet passage 48 having a 0.015 inch square section and a length of about 0.712 inches achieves a diffusion loss rate of about 0.00316 grams/day. This relatively low diffusion loss will ensure proper operation of the valve for at least a six month life of the pen in an extremely dry environment.

Having described and illustrated the principles of the invention with reference to preferred embodiments, it should be apparent that the invention can be further modified in arrangement and detail without departing from such principles. For example, a second vent 52' (dashed lines in FIG. 6) may be added to the valve 20, along with an associated outlet passage segment 50' connected to outlet passage 50 for providing an open, operable valve when the pen is oriented sideways. As a result, the pen could be employed for printing in either of two (upright or sideways) orientations.

In view of the above, it is to be understood that the present invention includes all such modifications as may come within the scope and spirit of the following claims and the equivalents thereof.

We claim:

1. A valve apparatus for controlling flow of a gas into a container, comprising:

a housing connected to the container and having an interior chamber, the chamber having a first amount of a liquid stored therein to fill the chamber to a first level when the apparatus is in an upright position;

inlet means for permitting the gas to flow into the chamber, the inlet means including an inlet aperture positioned at a second level below the first level when the apparatus is in the upright position; and vent means connected to the housing for permitting flow of gas from the chamber into the container and preventing flow of the liquid from the chamber into the container, the vent means including a vent aperture positioned at a third level above the first level when the apparatus is in the upright position, such that the gas entering the inlet aperture bubbles through the liquid and moves through the vent aperture when the apparatus is in the upright position, in the chamber the liquid therein will extend between the vent aperture and the inlet aperture irrespective of the position of the apparatus.

2. The apparatus of claim 1 wherein the vent means includes a porous member attached to the housing between the chamber and the container, the porous member being completely uncovered by the liquid when the apparatus is in the upright position.

3. The apparatus of claim 2 wherein the apparatus is positionable in an inverted position that is inverted relative to the upright position, so that the porous member is covered with the liquid when the apparatus is in the inverted position.

4. The apparatus of claim 2 wherein the porous member has a hydrophobic characteristics, and wherein the liquid in the chamber is an aqueous fluid.

5. The apparatus of claim 4 wherein the porous member is made of polytetrafluoroethylene.

6. The apparatus of claim 4 wherein the porous material comprises a membrane.

7. The apparatus of claim 4 wherein the porous material comprises a plug, at least a portion of the plug being compressed within the vent aperture.

8. The apparatus of claim 1 wherein the inlet means includes an elongated passage extending from the chamber for directing through the passage a portion of the gas residing outside the container into the chamber and for receiving within the passage a portion of the liquid stored in the chamber whenever the pressure in the chamber increases while the container is in a position such that the inlet aperture and vent aperture are covered by the liquid.

9. The valve apparatus of claim 8 wherein the passage includes two contiguous sections, wherein one section has a cross section smaller than the cross section of the other section, the one section restricting more than the other section mass diffusion of the liquid out of the chamber through the passage.

10. The apparatus of claim 1 wherein the inlet means includes an elongated first passage extending from the chamber to outside the container for directing through the first passage a portion of the gas residing outside the container into the chamber.

11. The apparatus of claim 10 wherein the vent means includes an elongated second passage extending from the vent means to the container for directing the gas from the chamber to the container.

12. The apparatus of claim 11 wherein the vent means includes a porous member attached to the housing between the first passage and the second passage, the liquid being stored between the porous member and the first passage.

13. The apparatus of claim 11 wherein the container contains a second liquid and wherein the second passage includes capillary means for defining a meniscus within a portion of the second liquid when said portion of the second liquid is forced from the container into the second passage as a result of a pressure increase within the chamber relative to the pressure of the gas in the chamber, thereby to occlude the second passage with the second liquid.

14. The apparatus of claim 10 wherein the first passage includes capillary means for defining a meniscus within a portion of the liquid when said portion of the liquid moves from the chamber into the first passage as a result of a pressure increase within the chamber relative to the pressure of the gas outside the chamber, thereby substantially occluding the first passage.

15. A method of valving a flow of air through a passage in an apparatus and into a container that has an internal pressure less than that of ambient, comprising the steps of:

housing a liquid to cover one part of the passage when the apparatus is in an upright position for restricting the flow of ambient air through the passage;

positioning within the passage between the liquid and the container a porous vent member that is porous to air and substantially impermeable to the liquid; and maintaining the liquid to cover at least one of the one part of the passage and the vent member at all times, so that the vent member is covered with the liquid when the apparatus is tipped from the upright position, and so that the one part of the passage and the vent member are not simultaneously uncovered by the liquid irrespective of how the apparatus is oriented.

16. A valve apparatus for a pen that has an ink-containing reservoir having a fist pressure level established in the reservoir, the apparatus comprising:

a housing having an orifice formed therein for delivering air into the reservoir whenever the first pressure level is reduced to a second pressure level;

the housing defining a chamber adjacent to the orifice;

a porous vent member positioned between the reservoir and the chamber; and an operating liquid contained within part of the chamber, the liquid being flowable within the chamber for covering the orifice and the vent member, wherein the orifice and the vent member can not be simultaneously uncovered by the liquid irrespective of how the pen is oriented.

17. The apparatus of claim 16 wherein the housing includes an elongated inlet passage formed contiguous with the orifice for directing air outside the reservoir into the chamber.

18. The apparatus of claim 16 wherein the housing includes an elongated outlet passage formed adjacent to the vent member and extending from the vent member to the reservoir for directing air from the chamber to the reservoir, thereby to regulate changes in the pressure level in the reservoir.

* * * * *